US008806986B2

(12) United States Patent
Chen

(10) Patent No.: US 8,806,986 B2
(45) Date of Patent: Aug. 19, 2014

(54) RATCHET WRENCH WITH A BUSHING

(71) Applicant: Yi-Fu Chen, Taichung (TW)

(72) Inventor: Yi-Fu Chen, Taichung (TW)

( * ) Notice: Subject to any disclaimer, the term of this patent is extended or adjusted under 35 U.S.C. 154(b) by 0 days.

(21) Appl. No.: 13/853,035

(22) Filed: Mar. 28, 2013

(65) Prior Publication Data

US 2013/0213190 A1 Aug. 22, 2013

Related U.S. Application Data

(63) Continuation-in-part of application No. 13/015,583, filed on Jan. 28, 2011, now abandoned.

(51) Int. Cl.

| | |
|---|---|
| ***B25B 13/46*** | (2006.01) |
| ***B25B 1/02*** | (2006.01) |
| *B25B 23/00* | (2006.01) |
| *B25B 15/04* | (2006.01) |

(52) U.S. Cl.

CPC ..... *B25B 13/463* (2013.01); *B25D 2250/105* (2013.01); *B25B 1/02* (2013.01); *B25B 23/0035* (2013.01); *B25B 13/465* (2013.01); *B25B 15/04* (2013.01); *B25D 2250/361* (2013.01)

USPC ..... 81/62; 81/63.1

(58) Field of Classification Search

CPC .... B25B 13/463; B25B 15/04; B25B 13/465; B25B 23/0035; B25D 1/02; B25D 2250/105; B25D 2250/361

USPC ..... 81/58–63.2; 192/43–44

See application file for complete search history.

(56) References Cited

U.S. PATENT DOCUMENTS

| | | | | |
|---|---|---|---|---|
| 1,501,095 | A * | 7/1924 | Brock | 81/19 |
| 5,499,560 | A * | 3/1996 | Aeschliman | 81/63.2 |
| 6,053,077 | A * | 4/2000 | Huang | 81/63.1 |
| 6,260,449 | B1 * | 7/2001 | I-He | 81/63.2 |

* cited by examiner

*Primary Examiner* — Monica Carter
*Assistant Examiner* — Melanie Alexander

(57) ABSTRACT

A ratchet wrench includes a wrench head, a ratchet assembly and a bushing. The wrench head is made of metal and defines a cavity therein. The ratchet assembly is disposed in the cavity of the wrench head and has an outer configuration corresponding in shape to a periphery of the cavity of wrench head and being slightly smaller than the cavity of the wrench head. The bushing is made of a metal with a hardness greater than that of the wrench head and is fitted in a clearance defined between the ratchet assembly and an inner wall of the cavity of the wrench head. Moreover, the bushing has a substantially consistent thickness so that the bushing has an outer periphery and an inner periphery both corresponding in shape to the periphery of the cavity.

4 Claims, 5 Drawing Sheets

RATCHET WRENCH WITH A BUSHING

CROSS REFERENCE TO RELATED APPLICATIONS

This application is a continuation-in-part of U.S. patent application Ser. No. 13/015,583, filed Jan. 28, 2011, now U.S. Pub. No. 2012/0192683.

BACKGROUND OF THE INVENTION

1. Field of the Invention

The present invention relates to a ratchet wrench with a bushing, and more particularly to a ratchet wrench having a ratchet assembly mounted therein and enclosed by a bushing for preventing wearing of the ratchet assembly.

2. Description of Related Art

A conventional ratchet wrench has a ratchet disposed on a head thereof and mounted with a work piece for operating. An engaging member is selectively, engaged with the ratchet for limiting a rotating direction of the ratchet. A switch is movably mounted in the head. A pressing member is mounted in the switch and is located adjacent to the engaging member for abutting against the engaging member. When the switch is turned to a lateral side of the head, the pressing member is moved to abut against the engaging member. The engaging member is moved to abut against an inner periphery of the head and engage with the ratchet for allowing the ratchet to move in a corresponding rotating direction. Therefore, the ratchet is able to change the rotating direction by shifting the switch.

However, the prior art suffers from several disadvantages. Due to the abutting force between the engaging member and the inner periphery of the head, the engaging member would rub against the inner periphery of the head. The ratchet may be idling during engaging with the engaging member, such that the ratchet or the engaging member would rub against the inner periphery of the head. Accordingly, a gap which defines between the inner periphery of the head and the outer peripheries of the ratchet, the engaging member, and the switch may increase. Therefore, the connection of the components is easily loosened and the ratchet would move in an undesired rotating direction.

The present invention has arisen to mitigate and/or obviate the disadvantages of the conventional ratchet wrench.

SUMMARY OF THE INVENTION

The main objective of the present invention is to provide an improved ratchet wrench with a bushing.

To achieve the objective, a ratchet wrench with a bushing in accordance with the present invention is a ratchet wrench and comprises a cavity defined in a wrench head thereof. The cavity is divided into a first space, a second space, and a third space. The second space is located between the first space and the third space for communicating with the first and third space.

A ratchet assembly is movably received in the cavity for adapting to driving a work piece. The ratchet assembly has an outer configuration substantially corresponding in geometry to the cavity. The ratchet assembly comprises a ratchet gear rotatably received in the first space, a pawl movably received in the second space, and a switch member movably received in the third space. The pawl has a teeth formed on a top thereof for selectively engaged with the ratchet gear. A plunger is movably mounted in the switch member. The plunger selectively and adjustably abuts against a bottom of the pawl opposite to the teeth of the pawl by shifting the switch member;

A bushing is disposed between the ratchet assembly and an inner periphery of the cavity. The bushing has an outer periphery substantially corresponding to the inner periphery of the cavity and encloses the outer configuration of the ratchet assembly. The bushing and the wrench head of the ratchet wrench are made of different metal materials. The bushing has a hardness greater than that of the inner periphery of the cavity of the wrench head.

Therefore, when the ratchet assembly is operated, the bushing is able to resist wear of the ratchet assembly. A rotating direction of the ratchet gear is controllable by changing an engagement of the teeth of the pawl.

In accordance with another aspect of the present invention, the cavity is divided into a first space and a second space communicating with the first space. The wrench head has two recesses defined in an inner periphery of the second space. The bushing has two curved portions formed in a bottom thereof for being correspondingly and respectively received in the two recesses. The ratchet assembly comprises a ratchet gear rotatably received in the first space and two pawls movably receiving in the second space. Each pawl has a pivot portion formed on a bottom thereof and pivotally mounted in the corresponding curved portion for abutting against the bushing. Each pawl has teeth formed on a top thereof for selectively engaged with the ratchet gear.

A switch member is movably received in the second space and located between the two pawls. The switch member has a flat portion and a protruding portion oppositely formed in an outer periphery thereof for respectively and laterally abutting against the two pawls. Two elastomers are compressibly received in the second space. Each elastomer is disposed between the corresponding pawl and the inner periphery of the bushing for providing a resilient force.

When the protruding portion of the switch member is shifted to abut against one pawl, the pawl is pivotally moved to compress the corresponding elastomer and disengages from the ratchet gear. The other pawl is pivotally moved to abut against the flat portion by the resilient force of the corresponding elastomor and engage with the ratchet gear, such that a rotating direction of the ratchet gear is controllable.

In accordance with another aspect of the present invention, the cavity is divided into a first space and a second space communicating with the first space. The ratchet assembly comprises a ratchet gear rotatably received in the first space and a pawl movably received in the second space. The pawl has teeth formed on a top thereof for selectively engaged with the ratchet gear. The pawl has a first abutting surface for abutting against an inner periphery of the bushing and a second abutting surface which is located opposite to the first abutting surface. An elastomer is compressibly received in the second space. The elastomer has two ends respectively abutting against the second abutting surface of the pawl and the inner periphery of the bushing for providing a resilient force.

When the pawl is driven to compress the elastomer, the ratchet gear is rotatable. When the pawl abuts against the inner periphery of the bushing, the ratchet gear is engagingly restricted with the teeth of the pawl.

Further benefits and advantages of the present invention will become apparent after a careful reading of the detailed description with appropriate reference to the accompanying drawings.

DETAILED DESCRIPTION OF THE INVENTION

Figure 1:
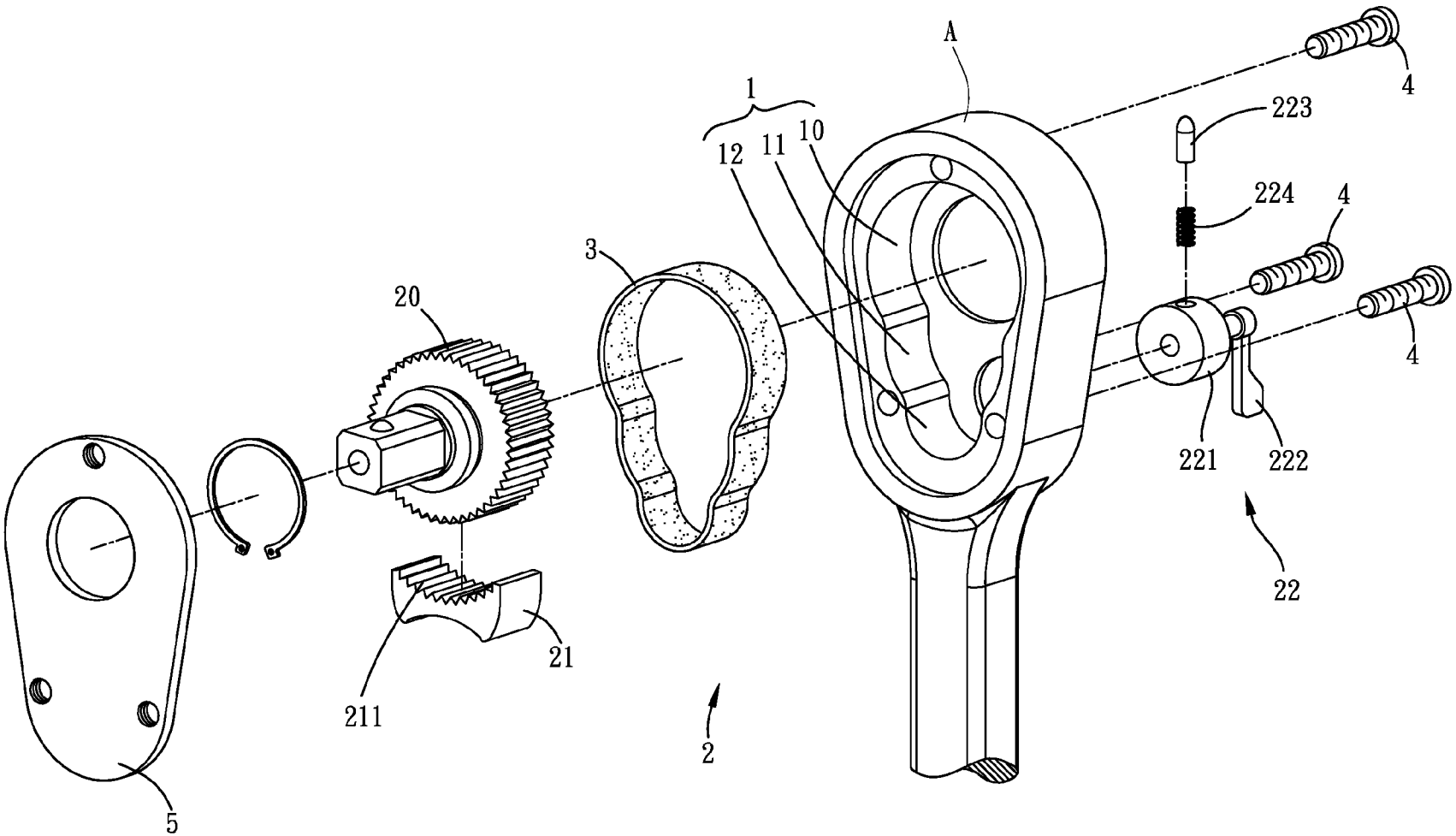
FIG. 1 is an exploded perspective view of a preferred embodiment of a ratchet wrench with a bushing in accordance with the present invention.
Figure 2:
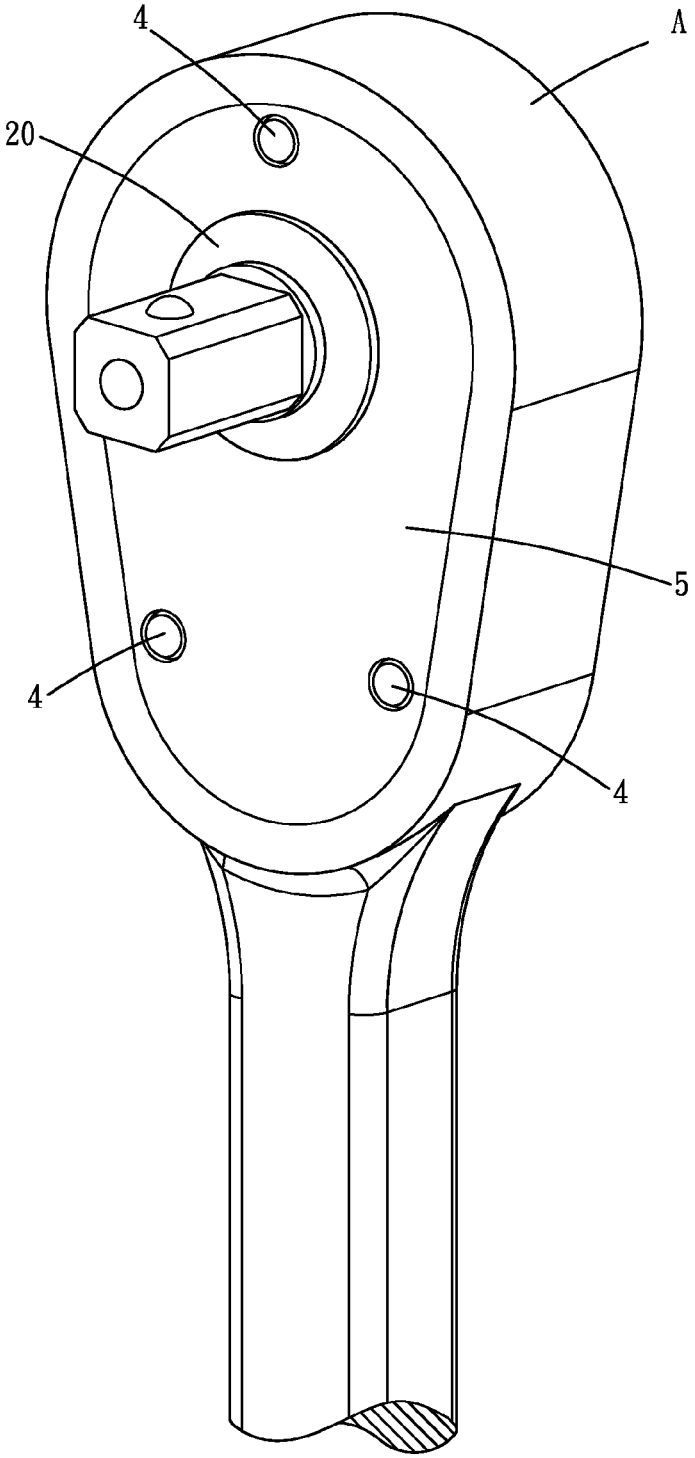
FIG. 2 is an assembled perspective view of the preferred embodiment of the ratchet wrench with a bushing in accordance with the present invention.
Figure 3:
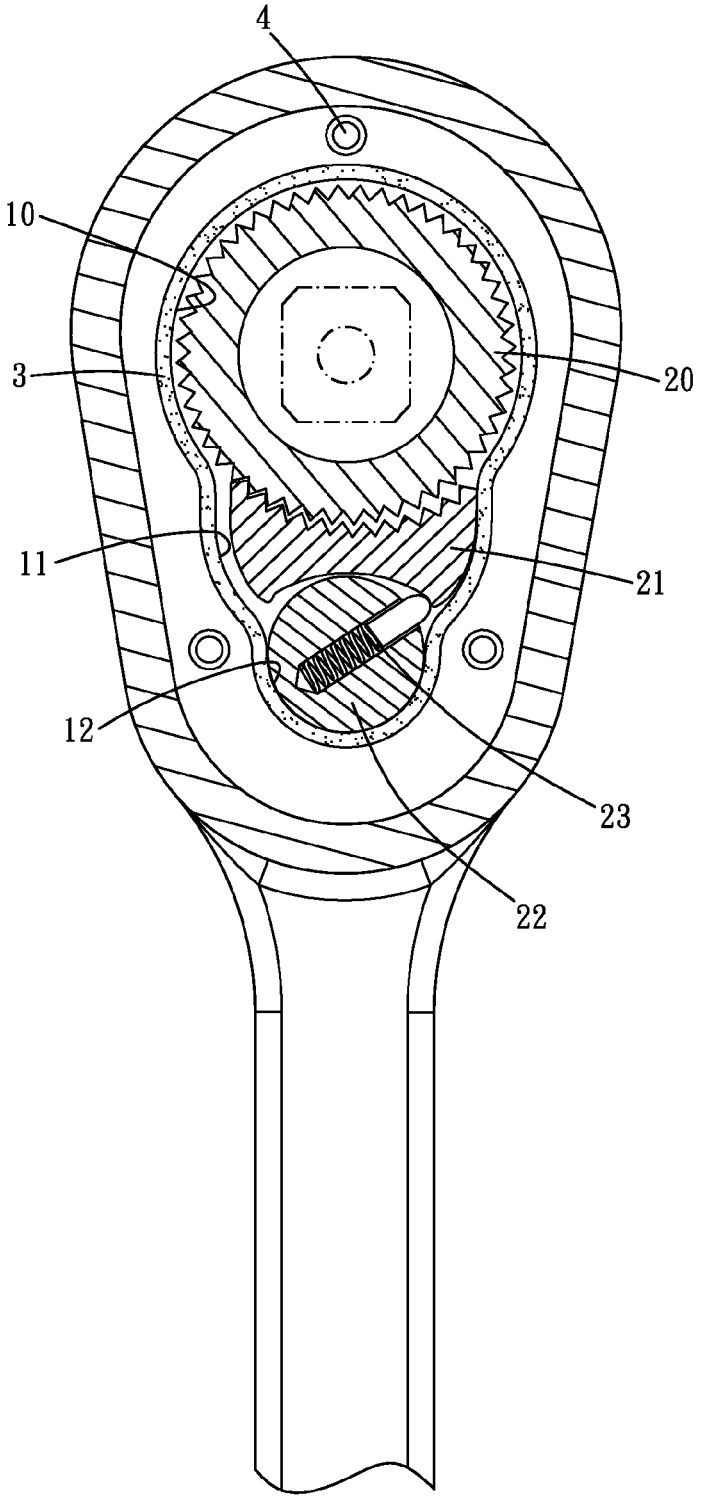
FIG. 3 is a partial cross-sectional view of the preferred embodiment of the ratchet wrench with a bushing in accordance with the present invention.

Referring to the drawings and initially to FIGS. 1-3, a ratchet wrench in accordance with a first embodiment of the present invention comprises a wrench head A that defines a cavity 1 therein. The cavity 1 is divided into a first space 10, a second space 11, and a third space 12. The second space 11 is located between the first space 10 and the third space 12 for communicating with the first space 10 and the third space 12.

A ratchet assembly 2 is movably received in the cavity 1 for driving a work piece (not shown). The ratchet assembly 2 has an outer configuration substantially corresponding in shape to a periphery of the cavity 1 of the wrench head A and being slightly smaller than the cavity 1. The ratchet assembly 2 comprises a ratchet gear 20 rotatably received in the first space 10, a pawl 21 movably received in the second space 11, and a switch member 22 movably received in the third space 12 and configured to selectively actuating the pawl 21 to engage with the ratchet gear 20 and to control an active direction of the ratchet gear 20. Specifically, the ratchet gear 20 has a plurality of teeth (not numbered) formed on an outer periphery thereof. The pawl 21 has an upper concave surface with teeth 211 formed thereon for selective engagement with the teeth of the ratchet gear 20 and a lower concave surface confronting the switch member 22. The switch member 22 includes a body 221, a lever 222, extending from the body 221, a spring 224 mounted in a recess of the body 221 and a plunger 223 mounted in the recess of the body 221 to be thrust by the spring 224. The plunger 223 is biased by the spring 224 to abut against the lower concave surface. The lever 222 is operable to have the plunger 223 abut against a side of the lower concave surface of the pawl 21, as depicted in FIG. 3, for selectively actuating the pawl 21 to engage with the ratchet gear 20 and to control the active direction of the ratchet gear 20.

A bushing 3 encloses the outer configuration of the ratchet assembly 2 and is fitted in a clearance defined between the ratchet assembly 2 and an inner wall of the cavity 1 of the wrench head A. As shown in FIG. 3, the bushing 3 encloses the ratchet gear 20, the pawl 21 and the switch member 22 together. In particular, the bushing 3 has a substantially consistent thickness so that the bushing 3 has an outer periphery and an inner periphery both corresponding in shape to the periphery of the cavity 1. The bushing 3 and the wrench head A of the ratchet wrench are made of different metal materials. The bushing 3 has a hardness greater than that of the wrench head A, and therefore the bushing 3 helps to resist wear from the ratchet assembly 2. A cover plate 5 securely covers the cavity 1 and fastens to the wrench head A via a plurality of screws 4 for positioning the ratchet assembly 2 and the bushing 3 in the cavity 1.

The operation of the ratchet wrench with bushing in accordance with the present invention will be described in detailed below. As shown in FIG. 3, the plunger 23 is moved to abut against the bottom of the pawl 21 by pivotally rotating the switch member 22. A rotating direction of the ratchet gear 20 is controllable by changing an engagement between the teeth 211 of the pawl 21 and the teeth of the ratchet gear 20.

Figure 4:
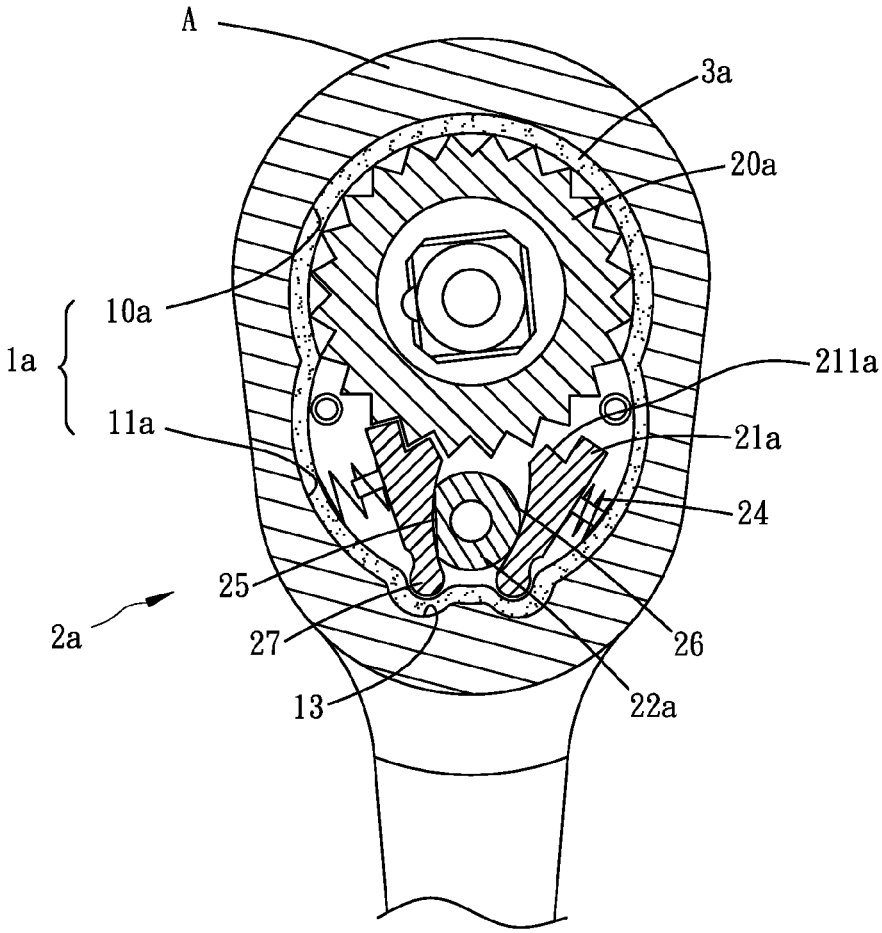
FIG. 4 is a partial cross-sectional view of a second embodiment of the ratchet wrench with a bushing in accordance with the present invention.
Figure 5:
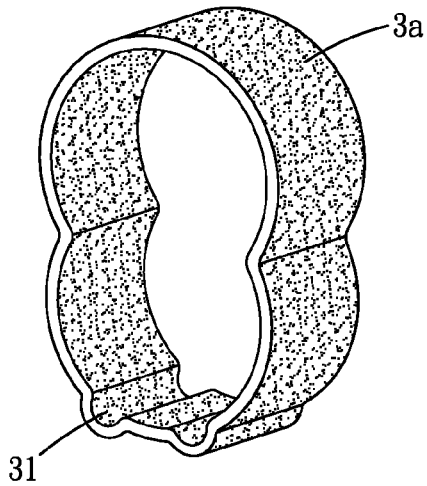
FIG. 5 is a perspective view of the second embodiment of a bushing of the ratchet wrench with a bushing in accordance with the present invention.

FIGS. 4-5 show a second embodiment of the ratchet wrench with a bushing according to the present invention. The elements and effects of the second embodiment which are the same with the preferred embodiment are not described, only the differences are described. The cavity la is divided into a first space 10*a* and a second space 11*a* communicating with the first space 10*a*. The wrench head A has two recesses 13 defined in an inner periphery of the second space 11*a*. The bushing 3*a* has two curved portions 31 formed in a bottom thereof for being correspondingly and respectively received in the two recesses 13. The bushing 3*a* has an outer periphery substantially corresponding to the inner periphery of the cavity la and encloses the outer configuration of the ratchet assembly 2*a*. The ratchet assembly 2*a* comprises a ratchet gear 20*a* rotatably received in the first space 10*a* and two pawls 21*a* pivotally receiving in the second space 11*a*. Each pawl 21*a* has a pivot portion 27 formed on a bottom thereof and mounted in the corresponding curved portion 31 for abutting against the bushing 3*a*, such that the two pawls 21*a* are pivotally and respectively rotatable about the two pivot portions 27. Each pawl 21*a* has teeth 211*a* formed on a top thereof for selectively engaged with the teeth of the ratchet gear 20*a*.

A switch member 22*a* is movably received in the second space 11*a* and located between the two pawls 21*a*. The switch member 22*a* has a flat portion 25 and a protruding portion 26 oppositely formed in an outer periphery thereof for respectively and laterally abutting against the two pawls 21*a*. Two elastomers 24 are compressibly received in the second space 11*a*. Each elastomer 24 is disposed between the corresponding pawl 21*a* and the inner periphery of the bushing 3*a* for providing a resilient force.

When the protruding portion 26 abuts against one pawl 21*a* by pivotally rotating the switch member 22*a*, the pawl 21*a* is pivotally moved to compress the corresponding elastomer 24 and disengages from the ratchet gear 20*a*. The other pawl 21*a* is pivotally moved to abut against the flat portion 25 by the resilient force of the corresponding elastomor 24 and engage with the ratchet gear 20*a*, such that a rotating direction of the ratchet gear 20*a* is controllable.

Figure 6:
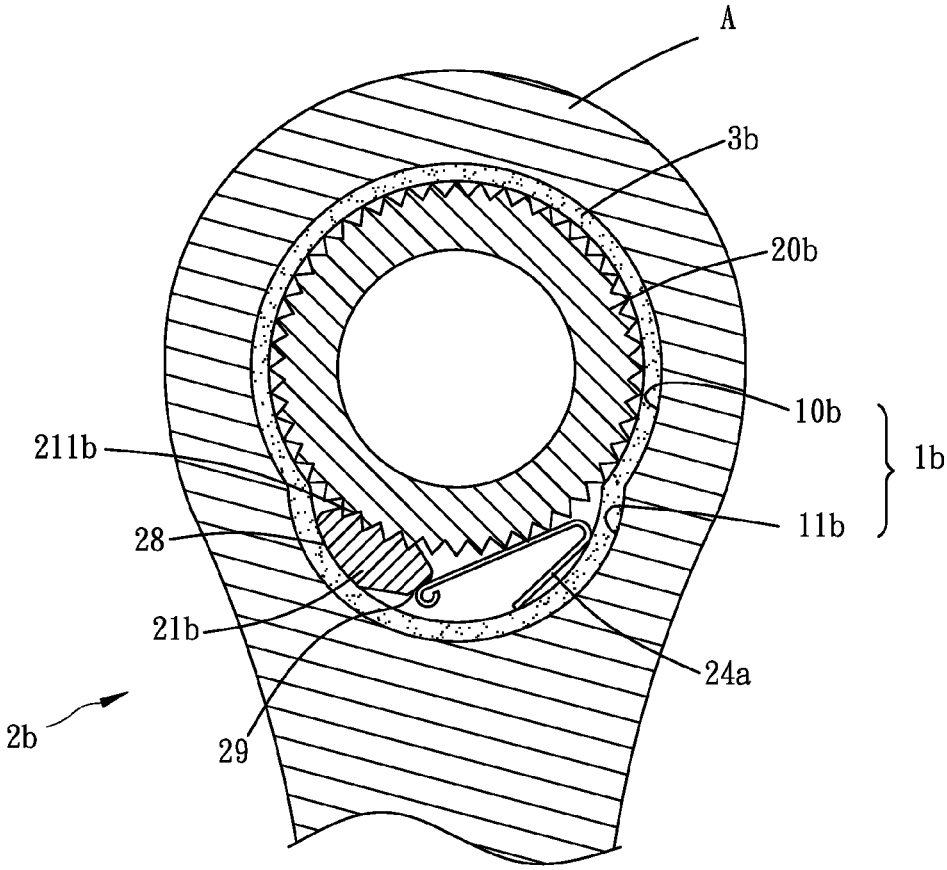
FIG. 6 is a partial cross-sectional view of a third embodiment of the ratchet wrench with a bushing in accordance with the present invention.
Figure 7:
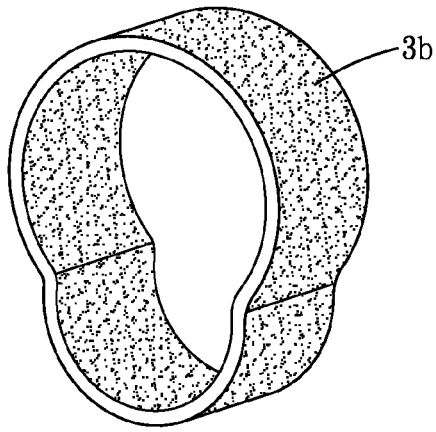
FIG. 7 is a perspective view of the third embodiment of a bushing of the ratchet wrench with a bushing in accordance with the present invention.

FIGS. 6-7 show a third embodiment of the ratchet wrench with a bushing according to the present invention. The elements and effects of the third embodiment which are the same with the preferred embodiment are not described, only the differences are described. The cavity lb is divided into a first space 10*b* and a second space 11*b* communicating with the first space 10*b*. The bushing 3*b* has an outer periphery substantially corresponding to the inner periphery of the cavity 1*b* and encloses the outer configuration of the ratchet assembly 2*b*. The ratchet assembly 2*b* comprises a ratchet gear 20*b* rotatably received in the first space 10*b* and a pawl 21*b* movably received in the second space 11*b*. The pawl 21*b* has teeth 211*b* formed on a top thereof for selectively engaged with the teeth of the ratchet gear 20*b*. The pawl 21*b* has a first abutting surface 28 for abutting against an inner periphery of the bushing 3*b* and a second abutting surface 29 which is located opposite to the first abutting surface 28. An elastomer 24*a* is compressibly received in the second space 11*b*. The elastomer 24*a* has two ends respectively abutting against the second abutting surface 29 of the pawl 21*b* and the inner periphery of the bushing 3*b* for providing a resilient force.

When the pawl 21*b* is driven to compress the elastomer 24*a*, the ratchet gear 20*b* is rotatable. When the pawl 21*b* abuts against the inner periphery of the bushing 3*b*, the ratchet gear 20*b* is engagingly restricted with the teeth 211*b*.

Although the invention has been explained in relation to its preferred embodiment, it is to be understood that many other possible modifications and variations can be made without departing from the spirit and scope of the invention as hereinafter claimed.

What is claimed is:

1. A ratchet wrench comprising:

a wrench head made of metal and defining a cavity therein;

a ratchet assembly disposed in the cavity of the wrench head, having an outer configuration corresponding in shape to a periphery of the cavity of wrench head and being slightly smaller than the cavity of the wrench head; and a bushing made of a metal with a hardness greater than that of the wrench head, being fitted in a clearance defined between the ratchet assembly and an inner wall of the cavity of the wrench head, and having a substantially consistent thickness so that the bushing has an outer periphery and an inner periphery both corresponding in shape to the periphery of the cavity.

2. The ratchet wrench of claim 1, wherein the cavity of the wrench head includes a first space, a second space communicating with the first space, and a third space communicating with the second space; and the ratchet assembly includes a ratchet gear rotatably received in the first space of the wrench head, a pawl movably received in the second space of the wrench head, and a switch member movably received in the third space and configured to selectively actuating the pawl to engage with the ratchet gear and to control an active direction of the ratchet gear; and the ratchet gear, the pawl and the switch member together are enclosed by the bushing.

3. The ratchet wrench of claim 2, wherein the pawl has an upper concave surface with teeth formed thereon for selective engagement with that of the ratchet gear and a lower concave surface confronting the switch member; the switch member includes a body, a lever extending from the body, a spring mounted in a recess of the body and a plunger mounted in the recess of the body to be thrust by the spring; and the lever is operable to have the plunger abut against a side of the lower concave surface of the pawl for selectively actuating the pawl to engage with the ratchet gear and to control the active direction of the ratchet gear.

4. The ratchet wrench of claim 1, further comprising two or more screws and a cover plate engaged with the wrench head via the screws to cover the cavity of the wrench head for positioning the ratchet assembly and the bushing in the cavity.

* * * * *